United States Patent [19]

Ridgley

[11] Patent Number: 4,616,752

[45] Date of Patent: Oct. 14, 1986

[54] PILL DISPENSER

[76] Inventor: Brad Ridgley, 16400 Ventura Blvd., #233, Encino, Calif. 91436

[21] Appl. No.: 666,550

[22] Filed: Oct. 30, 1984

[51] Int. Cl.[4] ..... B65D 83/04

[52] U.S. Cl. ..... 206/533; 220/4 D; 220/69; 206/521

[58] Field of Search ..... 206/533, 538, 521; 220/4 C, 4 D, 23.83, 69; 221/75, 92; 222/143; 248/603, 615, 629

[56] References Cited

U.S. PATENT DOCUMENTS

| | | | |
|---|---|---|---|
| D. 238,751 | 2/1976 | MacGrossen . | |
| D. 274,040 | 5/1984 | Ridgley . | |
| 1,155,562 | 10/1915 | Gilchrist . | |
| 2,514,416 | 7/1950 | Plunkett . | |
| 2,774,466 | 12/1956 | Liska . | |
| 2,919,046 | 12/1959 | Parsons | 206/521 X |
| 3,268,199 | 8/1966 | Kordyban et al. | 220/69 |
| 3,335,915 | 8/1967 | Shannon . | |
| 3,365,099 | 1/1968 | McTaggart . | |
| 3,719,272 | 3/1972 | Bodine et al. | 220/4 D X |
| 3,863,804 | 2/1975 | Infante-Diaz et al. . | |
| 3,995,767 | 12/1976 | Brindley et al. . | |
| 4,053,054 | 10/1977 | Lucas . | |
| 4,151,910 | 5/1979 | Yasur . | |
| 4,288,006 | 9/1981 | Clover, Jr. . | |
| 4,311,237 | 1/1982 | Hayes | 220/4 D X |
| 4,381,059 | 4/1983 | Schurman | 206/533 |

FOREIGN PATENT DOCUMENTS

| | | |
|---|---|---|
| 129718 | 12/1946 | Australia . |
| 513979 | 9/1952 | Belgium . |

*Primary Examiner*—Steven M. Pollard

*Attorney, Agent, or Firm*—Spensley Horn Jubas & Lubitz

[57] ABSTRACT

A multi-compartmented pill dispenser having a plurality of vertical compartment modules. Each module has a sloping floor to facilitate the removal of pills from the dispenser. The dispenser is resiliently supported at its base to provide vibratory motion when tapped. A locking mechanism includes a bar adjacent the doors of the compartment modules. The bar is movable between a locked position in which the doors are engaged and a released position in which the doors are free to open.

16 Claims, 12 Drawing Figures

FIG. 6
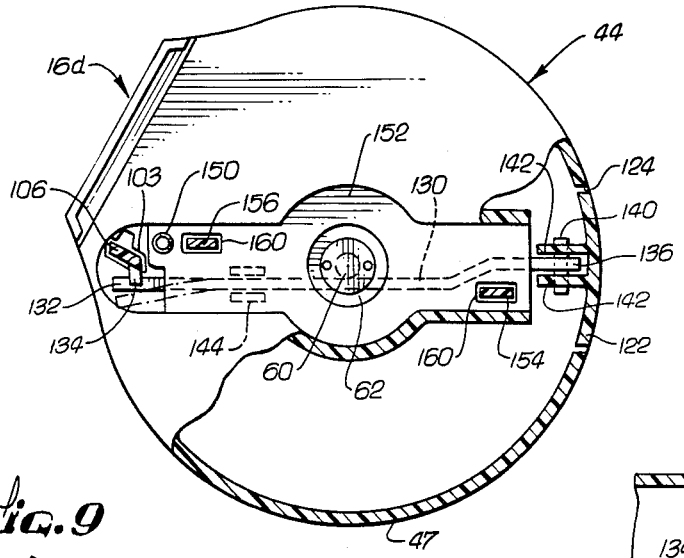
FIG. 9
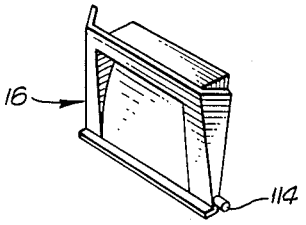
FIG. 7
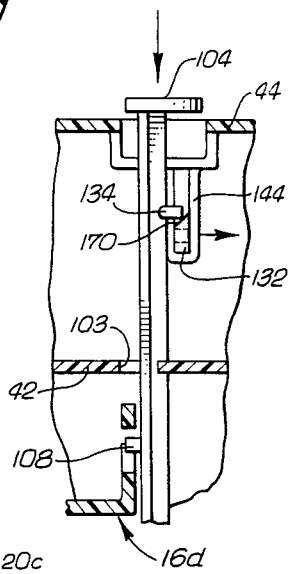
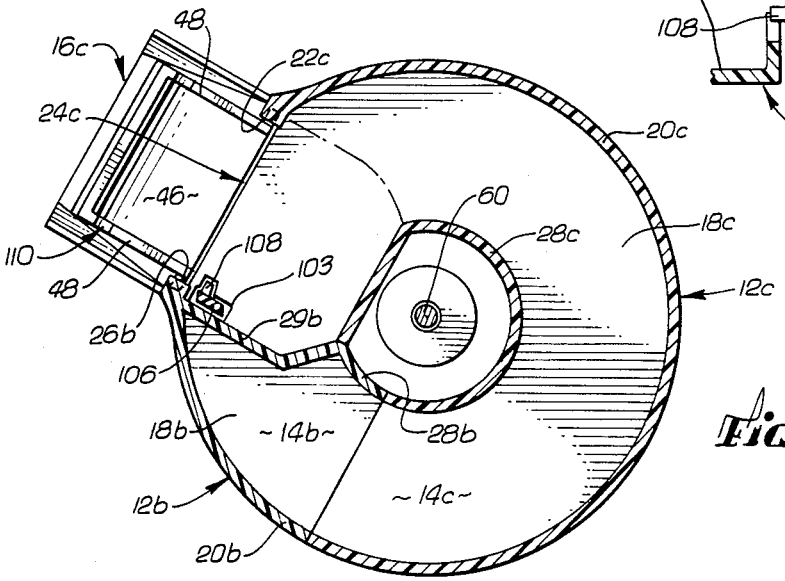
FIG. 8

PILL DISPENSER

BACKGROUND OF THE INVENTION

1. Field of the Invention

The present invention relates to mechanical devices for dispensing a limited quantity of small objects, and more specifically pill dispensers.

2. Prior Art

Pill and tablet dispensers in the past have primarily been oriented toward dispensing controlled portions of a single item, such as vitamin pills or medication tablets. However, with the rise in the number of vitamin and health pills and tablets available in the market, pill dispensers dedicated to a single type of tablet or pill create as much clutter and confusion as the original containers. It is desirable, therefore, to have a neat, attractive, and functional pill dispenser that can fit on a user's table top or counter, take up a minimum of space, and yet provide controlled dispensing of a multitude of different types of pills and tablets.

Multi-compartmented dispensers have previously been proposed for a variety of products. However, many of these previous designs are relatively expensive to manufacture. It is an object of this invention to provide a multi-compartmented pill dispenser which is readily manufactured and is suitable for counter or table top containment of a plurality of pill types.

Another problem with many previous pill dispensers is that children can gain access to the pills contained therein. An unsupervised child might consume pills which would be detrimental to his or her health. Other pill and tablet dispensers in the past have incorporated child-resistant features to make it more difficult for a child to open the container. However, these child-resistant features often make access too difficult for the intended user. It is a further object of this invention to provide a child-resistant locking mechanism for pill and tablet dispensers, which would provide ready access for adults.

Once a container has been opened, it is often difficult to remove a pill or tablet from the container. Various dispenser mechanisms have been devised but these mechanisms have tended to be relatively complicated and expensive to manufacture. Furthermore, these mechanisms are often not readily adapted to multi-compartmented dispensers. It is therefore another object of the present invention to provide a pill dispenser in which the pills are easily removed once the child-resistant locking mechanism has been "unlocked".

These and other objects, features, and advantages of the invention are accomplished by the child-resistant multi-compartmented pill dispenser disclosed herein.

BRIEF DESCRIPTION OF THE DRAWINGS

FIG. 6 is a cross-sectional view of the dispenser of FIG. 4 taken along the line 6—6, with a portion broken away;

FIG. 7 is a cross-sectional view of the top portion of the dispenser of FIG. 4 taken along the line 7—7;

FIG. 8 is a cross-sectional view of the dispenser of FIG. 4 taken along the line 8—8;

FIG. 9 is a perspective view of a door for a compartment of the dispenser of FIG. 1;

SUMMARY OF THE INVENTION

In one aspect of the present invention, a multi-compartmented pill dispenser is provided having a plurality of vertically stacked separable compartment modules. In one embodiment, each compartment module has a downward spiraling floor to guide the pills to a door of the module. In another embodiment, the module floors are flat but slanted to direct the pills to the door.

In another aspect of the present invention, the pill dispenser is resiliently supported at its base. Consequently, a tap applied to the pill dispenser produces a sharp vibratory motion in the pill dispenser to facilitate the movement of the pills towards the door.

In still another aspect of the present invention, a locking mechanism is provided which resists unauthorized opening of the pill dispenser by small children but is also readily released by the intended users of the pill dispenser. This is achieved by a locking mechanism which in the illustrated embodiment includes a bar positioned adjacent each door of the multi-compartmented dispenser. The bar is movable between a locked and unlocked position and has means for engaging each door to maintain the doors in a closed position when the bar is in the locked position.

DETAILED DESCRIPTION OF THE DRAWINGS

Referring to FIGS. 1–4, a child-resistant, multi-compartmented pill dispenser in accordance with a perferred embodiment of the present invention is indicated generally at 10. The dispenser 10 is generally cylindrical in shape and has several identical injection molded plastic compartment modules **12*a*–12*d*. The modules when stacked vertically, define a plurality of individual interior compartments 14*a*–14*d* (FIGS. 4 and 8) for separately storing different types of pills or tablets. Each compartment module has a single door (16*a*–16*d***) which pivots open and shut to provide access to the interior compartment of the compartment module.

Figure 4:
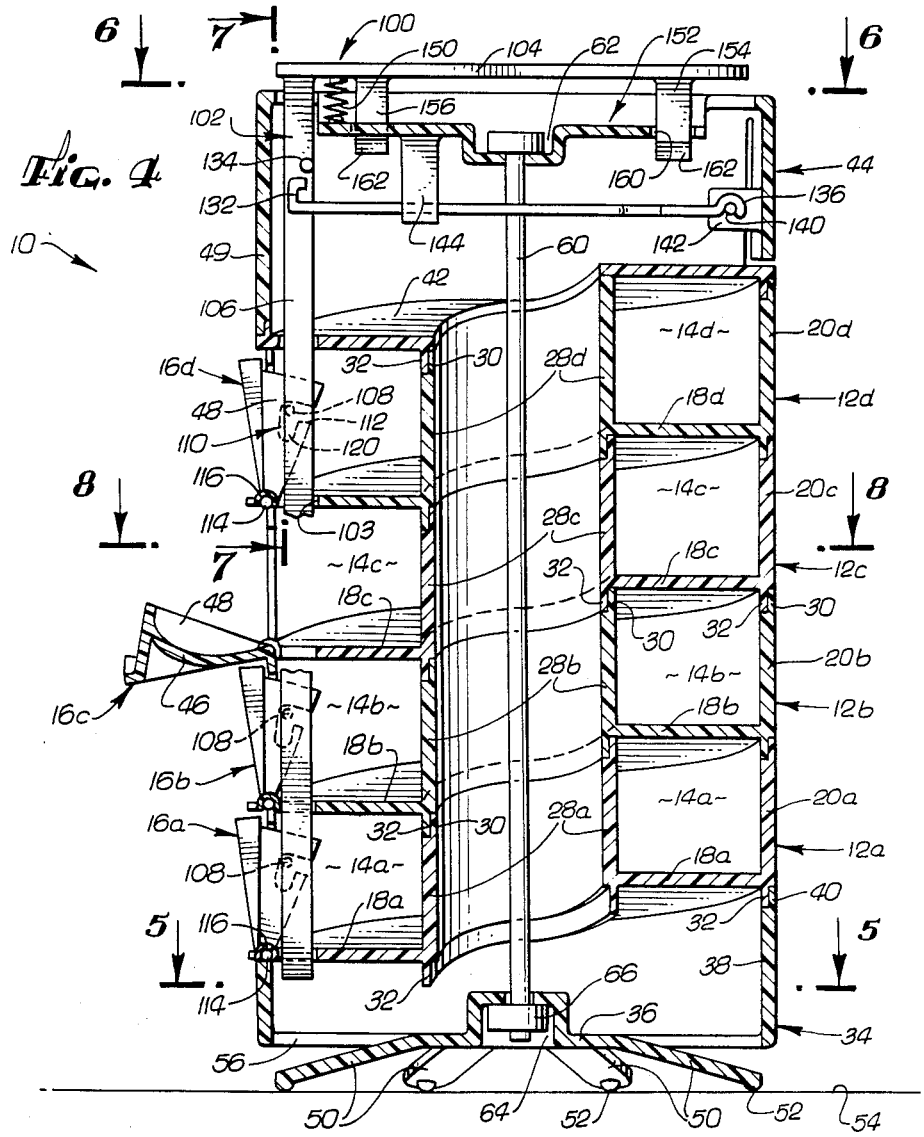
FIG. 4 is a sectional view of the pill dispenser of FIG. 1 taken along the line 4—4.

As best seen in FIG. 4, each compartment module also has a generally spiral-shaped floor (**18*a*–18*d*) which slopes downward to the door of that module. In the illustrated embodiment, the highest point of the floor is adjacent the upper right hand corner (as viewed in FIG. 3) of the door 16. From that point, the floor of each module slopes gently downward in a spiral to the lowest point which is adjacent the left hand side of the door 16** of the module.

An exterior wall (**20*a*–20*d*) of each module is integral with the module floor and has a substantially uniform width. Each module exterior wall (20*a*–20*d*) follows the slope of the module floor from the upper right hand corner of the module door to the left hand side of the module door. The left hand terminal edge (as indicated at 22c for the module 12c in FIGS. 1 and 8) of the exterior wall adjacent each door defines one side of the access opening (24a–24d) of each module. The openings 24a–24d are covered by the module door in the closed position. The right hand terminal edge (FIGS. 1 and 3) of the exterior wall of the module stacked below defines the right side of the access opening for each module 12b–12d as indicated at 26b of the module 12b for the access opening 24c of the module 12c in FIG. 8**.

Each compartment module further has an interior wall (28a–28d) which also follows the spiral slope of the module floor. The compartment interiors are separated by an interior wall of the module between the ends of the exterior and interior walls as indicated at 29b in FIG. 8 for the modules 12b and 12c. Thus, for example, the compartment interior 14c is defined by the module floor 18c, the exterior and interior module walls 20c and 28c, the end walls 29b and 29c (not shown) and the floor 18d of the module 12d stacked above. The downward sloping spiral shape of the floors together with the interior and exterior walls guide the pills contained within each compartment interior to the associated door of the compartment modules 12a–12d.

As shown in FIG. 4, the interior walls 28a–28d and exterior walls 20a–20d have upwardly extending vertical flanges 30 which are adapted to mate with downwardly extending vertical flanges 32 of the module above to provide secure stacking of the modules 12a–12d. The lower-most module 12a is carried by a cylindrical base cap member 34 which has a planar floor portion 36 and an integral exterior wall 38. The wall 38 has a gradually decreasing width to match the downward spiral of the compartment floor 18a. An upwardly extending flange member 40 of the wall 38 mates with the downwardly extending flange member 32 of the lower-most module 12a.

The interior 14d of the upper-most module 12d is enclosed by a spiral-shaped downward sloping ceiling member 42 which is in turn covered by a top cap member 44. The top cap member 44 has a planar portion 45 (FIG. 2) and an integral cylindrical exterior wall 47 which mates with the ceiling member 42 as shown in FIG. 4. A flat wall portion of 49 of the wall 47 (FIG. 1) is aligned with the doors 16a–16d of the modules 12a–12d.

Figure 1:
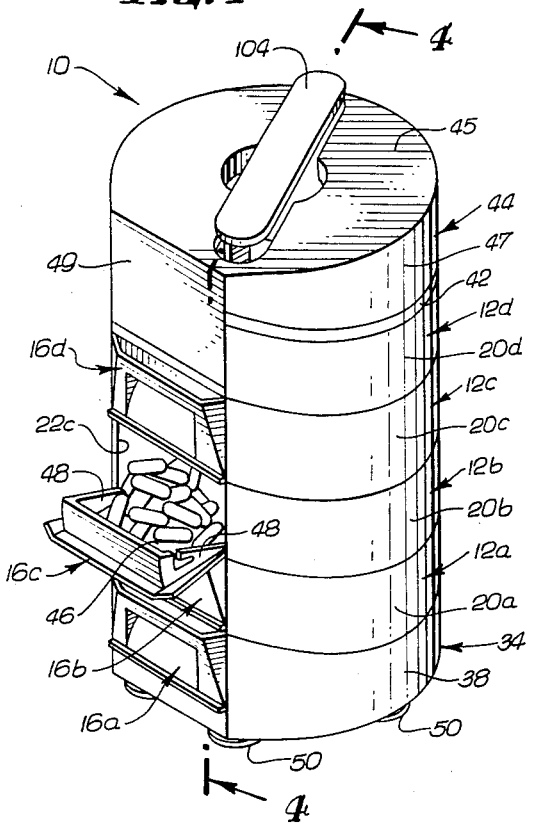
FIG. 1 is perspective view of a pill dispenser in accordance with a perferred embodiment of the present invention.

Each door has a curved wall 46 (FIG. 4) and a pair of integral side walls 48 which provide a cup for the pills to fall into when the doors are in the open position illustrated in FIG. 1. As shown in FIG. 4, the somewhat hook-shaped cross-section of the door wall 46 prevents the pills from spilling out of the door. Furthermore, the curvature of the door wall 46 allows the pills to be easily "flipped out" of the door by use of the user's fingers.

Figure 5:
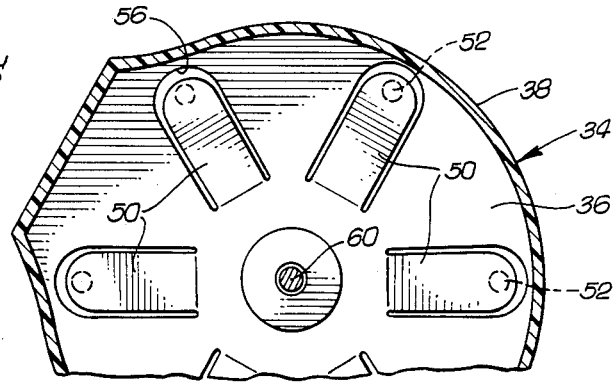
FIG. 5 is a partial plan view of the base of the dispenser of FIG. 1.

To facilitate the movement of pills from the compartment interiors to the open doors, the base cap member 34 has a purality of integral spring feet 50 (FIG. 5) which resiliently support the dispenser 10. By tapping downward on the top cap member 44 of the dispenser 10, the spring feet 50 are flexed thereby allowing the dispenser to vibrate. This vibratory motion jogs the pills to urge them down the sloping floor 18 out into an open door. As shown in FIG. 5, the spring feet 50 of the base cap 34 are arranged radially around the planar base portion 34 and have a small rounded protrusion 52 at the end of each foot 50 to make contact and reduce friction with the supporting surface 54 (FIG. 4).

The spring feet 52 are conveniently formed as generally planar integral extensions of the planar portion 36 of the base cap member 34. Openings 56 in the base portion 36 allow the ready removal of the base cap member 34 from the mold from which the cap is formed. It should be recognized however that other means such as coil springs and the like may be used to resiliently support the dispenser to provide the vibratory motion when the dispenser is tapped.

When assembled, the compartment modules 12a–12d and the end caps 34 and 44 are held together by a bolt 60 which extends the length of the dispenser 10. The bolt 60 is passed through an aperture in a central depression 62 in the top planar portion 45 of the top cap member 44 and extends through an aperture in a similar central depression 64 in the planar portion 36 of the base cap 34. A nut 66 is threadably attached to the end of the bolt 60 to secure the various components together. It should be recognized that the number of compartment modules in the dispenser 10 may be readily varied by providing a bolt 60 of the appropriate length.

In another aspect of the present invention, a locking mechanism in accordance with a preferred embodiment of the present invention is indicated generally at 100 in FIG. 4. The locking mechanism 100 allows the doors 16a–16d to be locked in the closed position to make it more difficult for small children to remove pills or tablets from the dispenser 10 when unattended. However, means are provided for readily releasing the locking mechanism 100 to provide ready access by the intended users.

The locking mechanism 100 includes a generally L-shaped locking bar 102 having a top push bar member 104 and an integral door bar member 106 extending longitudinally through apertures 103 in each of the compartment modules of the dispenser 10.

The locking bar 102 is movable between a "released position" illustrated in FIG. 4 in which all of the doors 16a–16d of the dispenser 10 are free to open and close. Manually pressing downward on the push bar member 104 moves the locking bar 102 to a "locked" position illustrated in FIG. 10. The door bar member 106 has a plurality of integral protrusions or pegs 108, each of which is positioned to project into an L-shaped slot 110 of an associated door. In the released position of FIG. 4, each peg 108 is positioned in an open top leg 112 of the L-shaped slot 110. The slot leg 112 is shaped so that the peg 108 of the locking bar 102 does not obstruct the free opening and closing of the doors 16. Each door 16a–16d has an integral pin 114 (FIG. 9) on either side which is carried in a semicircular depression 116 of the floor 18 of each module 12. The door 16 pivots about the projecting pins 114.

Figure 10:
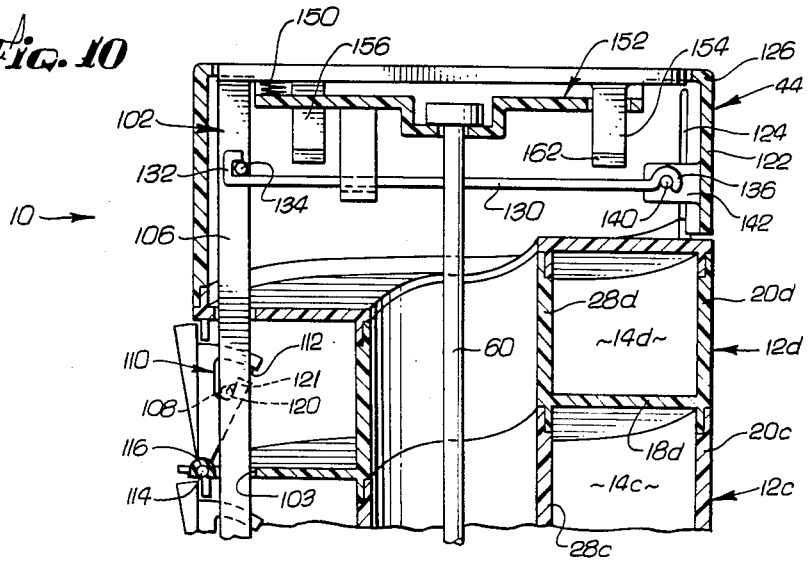
FIG. 10 is a partial cross-sectional view of the dispenser of FIG. 4 showing the locking mechanism in the "locked" position.

The second leg 120 of the door slot 116 extends in a generally vertical direction when the door is closed. When the locking bar 102 is pushed to the locked position, the pegs 108 move to the bottoms of the door slot second legs 120 as illustrated in FIG. 10. It is readily apparent that any attempt to open any of the doors 16a–16d will cause the peg 108 to engage a projecting member 122 defining the interior side of the door slot leg 120, thereby preventing the opening of that door.

The locking mechanism 100 is easily released by depressing a downwardly extending flap member 122 (FIG. 2) on the back side of the top cap member 44. The flap member 122 is defined by a generally U-shaped slot 124 and is joined to the remainder of the top cap member 44 by a living hinge in the area indicated at 126.

The door bar member 106 is releasably held in the locked position by a cross bar member 130 (FIG. 10) pivotally coupled to the cap flap member 122 at one end and having a hooked shaped end portion 132 at the other end. The end portion 132 engages a peg 134 of the door lock member 106 to prevent the locking bar 102 from moving up to the released position of FIG. 4.

The cross member 130 has a second hook shaped end 136 which is pivotally supported by a pivot pin 140 (FIG. 6) carried by two parallel flange members 142 extending from the top cap flap member 122. The other end of the cross bar 130 is supported by a U-shaped bracket 144 extending downwardly from the top cap member 44.

To release the locking mechanism 100, the cap flap member 122 is pressed inward producing a translational motion of the cross bar 130 to the left as viewed in FIGS. 4 and 10. This motion moves the hooked end portion 132 of the cross bar 130 out of the way of the peg 134 allowing the locking bar 102 to move upward under the urging of a spring 150 carried in a depression 52 of the top cap member 44. The top bar member 104 of the locking bar 102 has a pair of downwardly extending tab members 154 and 156 extending through slots 160 in the depression 152 of the top cap 44. Both tab members 154 and 156 have opposing lip extensions 162 which engage the underside of the depression 152 in the released position of the locking bar 102 to limit the travel of the locking bar 102 under the urging of the spring 150. The release pressure applied to the flap member 122 allows the resiliency of the hinge area 126 of the flap member 122 to return the cross bar member 130 to the position illustrated in FIG. 4.

Figure 2:
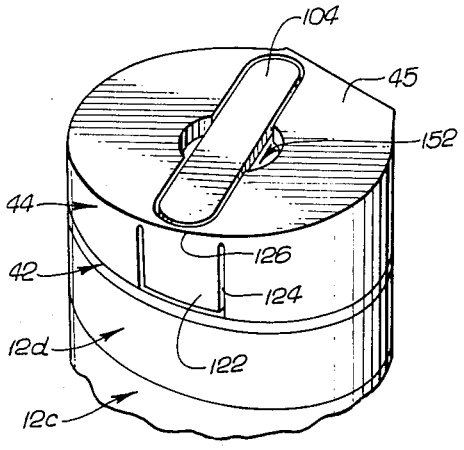
FIG. 2 is a partial perspective view of the top of the dispenser of FIG. 1.
Figure 3:
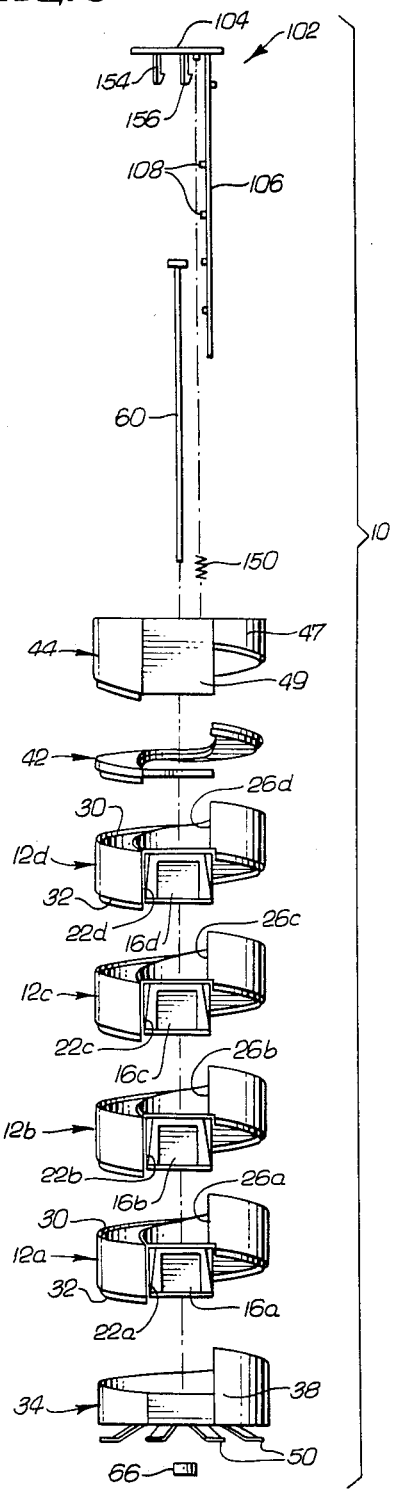
FIG. 3 is an exploded side view of the pill dispenser of FIG. 1.

After the desired pills have been removed from the various compartments of the dispenser 10, the locking mechanism 100 is relocked by manually pressing downward on the top bar member 104 of the locking bar 102. The downward motion of the locking bar 102 causes the latch peg 134 to engage a camming surface 170 (FIG. 7) of the hooked end portion 132 of the cross bar 130, thereby pushing the hooked end portion 132 out of the way of latch peg 134 as indicated in phantom in FIG. 6. When the locking bar 102 reaches the locked position, the latch peg 134 is in the center of the hooked end portion 132 allowing the hooked end portion 132 to snap back around the latch peg 134 thereby securing the locking bar 102 in place until released by depressing the cap flap 122. In the locked position, the top bar member 104 is flush with the planar surface 45 of the top cap 44 as shown in FIG. 2.

After the supply of pills has been exhausted in one of the modules, the dispenser is disassembled by removing the nut 56 and lifting the top cap member 44 with the bolt 60 and locking mechanism 100 off the modules 12*a*–12*d*. The modules may then be separated and refilled as necessary. The top cap member 44 is then replaced atop the modules with the locking bar 102 inserted through the base cap member 66 and the nut 66 is reattached. It is seen that the locking mechanism 108 is readily adapted for use with a varying number of modules.

Figure 11:
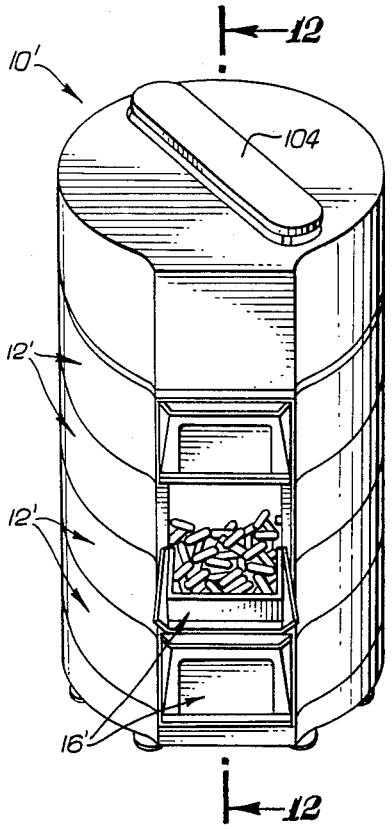
FIG. 11 is a perspective view of an alternative embodiment the pill dispenser of FIG. 1.
Figure 12:
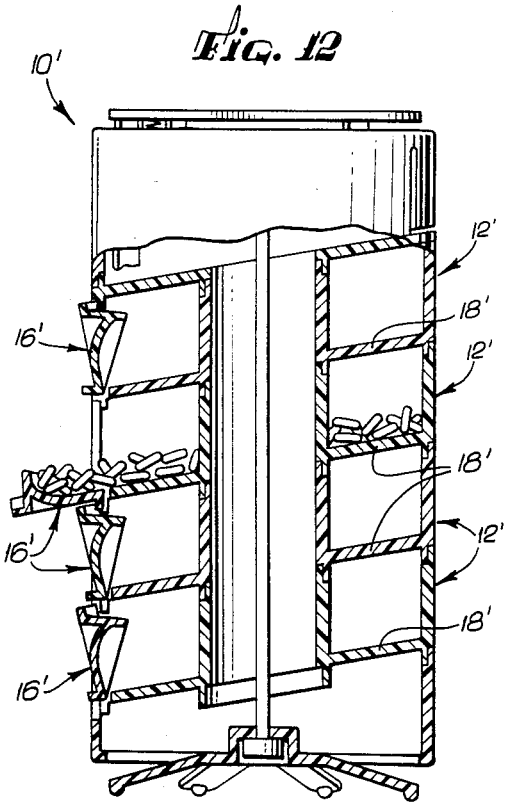
FIG. 12 is a cross-sectional view of the dispenser of FIG. 11 taken along the line 12—12.

FIGS. 11 and 12 show an alternative embodiment designated 10′ of the pill dispenser 10 of FIGS. 1–10. The dispenser 10′ is similar to the pill dispenser 10 except that the floors 18′ of the modules 12′ are flat rather than having the spiral shape of the floors 18 of the dispenser 10. However, the floors 18′ are slanted downward to the doors 16′ to faciliate easy removal of the pills or tablets.

It will, of course, be understood that modifications of the present invention, in its various aspects, will be apparent to those skilled in the art, some being apparent only after study and others merely being matters of routine mechanical design. For example, the pill dispenser may have a shape other than the cylindrical shape shown. In addition, the dispenser 10 may be made of materials other than the plastics described. Other embodiments are also possible wherein the specific design is dependent upon the particular application. As such, the scope of the invention should not be limited by the particular embodiments herein described but should be defined only by the appended claims and equivalents thereof.

What is claimed is:

1. A container for storing and dispensing pills comprising:

a wall defining an interior space within which pills are stored, said wall further defining an aperture providing access to the interior space; and a spiral-shaped downward sloping floor positioned relative to the aperture for supporting and guiding the pills to the aperture.

2. A container for storing and dispensing pills comprising:

a plurality of compartments, each compartment comprising a wall defining an interior space within which the pills are stored, said wall further defining an aperture providing access to the interior space; and a spiral-shaped downward sloping floor positioned relative to the aperture for supporting and guiding the pills to the aperture.

3. The container of claim 2 wherein the each compartment is a separate module and the modules are stacked vertically.

4. The container of claim 3 wherein each of the modules comprises a door for covering the aperture and the container further comprises means for releasably locking each door in a closed position.

5. The container of claim 4 further comprising spring means for resiliently supporting the container; wherein a vibratory motion may be induced in the container by striking the container.

6. A container for storing and dispensing pills comprising:

a plurality of vertically stacked compartment modules, each compartment module comprising a wall defining an interior space within which the pills are stored, said wall further defining an aperture providing access to the interior space; and a downward sloping floor positioned relative to the aperture for supporting and guiding the pills to the aperture.

7. The container of claim 6, wherein each of the compartment modules further comprises a door for covering an associated aperture and means for locking the doors in a closed position.

8. A container for storing and dispensing pills comprising:

a plurality of compartment modules, each compartment module defining an interior and having a door which provides access to the associated compartment interior when opened; and a locking mechanism comprising a bar positioned adjacent to each door, said bar being movable between a "locked"

position and "unlocked" position and having means for engaging each door to maintain the doors in the closed position when the bar is in a locked position, wherein said doors are free to open when the bar is in the unlocked position.

9. The container of claim 8 wherein each door has a slot and the means for engaging each door comprises a peg protruding from the bar into the slot wherein each door slot is shaped so that the door engages the associated bar peg when the bar is in the "locked" position to prevent opening the doors.

10. The container of claim 8 further comprising spring means for moving the bar from the locked to the unlocked position.

11. The container of claim 10 herein the locking mechanism further comprises means for releasably holding the bar in the locked position.

12. The container of claim 11 wherein the holding means includes a manually depressible member on the exterior of the container.

13. The container of claim 12 wherein the container has a cap member and the depressible member is a flap member integrally formed from the cap member.

14. The container of claim 12 wherein the holding includes a cross-member coupled to the depressible member at one end and adapted to engage and hold the bar in the locked position at the other end.

15. The container of claim 14 wherein the bar has a peg and the other end of the cross-member is shaped as a hook to engage the bar peg in the locked position of the bar, wherein movement of the depressible member moves the hooked end of the cross-member away from the bar peg to release the bar from the locked position.

16. The container of claim 15 wherein the cross-member hooked end has a camming surface positioned to be engaged by the bar peg so that the bar peg moves the cross-member hooked end out of the way of the bar peg as the bar moves to the hooked position.

* * * * *